United States Patent [19]

Voisin et al.

[11] Patent Number: 4,523,440

[45] Date of Patent: Jun. 18, 1985

[54] REGULATING DEVICE FOR THE LENGTH OF THREAD ABSORBED BY A KNITTING MACHINE

[75] Inventors: Eugène J. Voisin, Bouilly; Jean-Pierre A. Matthelié, La Chapelle St Luc; Jacques A. Mesny, Longvilliers, all of France

[73] Assignee: Institut Textile de France, Boulogne-Billancourt, France

[21] Appl. No.: 536,770

[22] Filed: Sep. 28, 1983

[30] Foreign Application Priority Data

Oct. 8, 1982 [FR] France ..... 82 16934
Dec. 28, 1982 [FR] France ..... 82 21935

[51] Int. Cl.[3] ..... D04B 15/44
[52] U.S. Cl. ..... 66/146; 66/132 R
[58] Field of Search ... 66/146, 125, 131, 132 R–132 T; 242/150 R, 150 M, 153, 154, 155 R, 155 M

[56] References Cited

U.S. PATENT DOCUMENTS

| | | | |
|---|---|---|---|
| 2,309,026 | 1/1943 | Thost | 66/146 |
| 2,692,735 | 10/1954 | Gill, Jr. . | |
| 3,231,216 | 1/1966 | Le Marchand | 242/154 X |
| 3,300,161 | 1/1967 | Hermanns | 242/154 |
| 3,408,832 | 11/1968 | Abe et al. | 66/146 |
| 3,578,256 | 5/1971 | Vermeulen | 242/154 |
| 3,746,226 | 7/1973 | LeClercq | 66/146 X |
| 3,918,275 | 11/1975 | Paepke | 66/146 X |
| 3,991,954 | 12/1976 | Schwartz . | |
| 4,194,375 | 3/1980 | Marchisio | 66/146 X |
| 4,209,881 | 7/1980 | Blore | 66/146 |

FOREIGN PATENT DOCUMENTS

| | | |
|---|---|---|
| 1499005 | 12/1965 | Fed. Rep. of Germany . |
| 1929705 | 6/1969 | Fed. Rep. of Germany . |
| 1952028 | 5/1970 | Fed. Rep. of Germany . |
| 1319433 | 1/1963 | France . |
| 1544469 | 11/1967 | France . |
| 2117575 | 7/1972 | France . |
| 2159806 | 6/1973 | France . |
| 2168644 | 8/1973 | France . |
| 2271162 | 5/1975 | France . |
| 2390359 | 5/1977 | France . |
| 2362228 | 3/1978 | France . |
| 814005 | 5/1959 | United Kingdom . |

*Primary Examiner*—Ronald Feldbaum
*Attorney, Agent, or Firm*—Shenier & O'Connor

[57] ABSTRACT

A device for regulating the length of thread absrobed by a knitting machine and/or for correcting the variations in tension of a thread supplying a textile machine, is disclosed. The device comprises a tensioning means of any type, a drive member whose rotation results in the movement of the tension-generating member of the tensioning means, a feeler element over which the thread passes and which is moved when the length of thread absorbed and/or the tension of the thread varies and two switches, one controlling the placing in rotation of the drive member in one direction and the other the placing in rotation in the other direction. The direction of rotation of the drive member is selected so that the corelative action of the feeler corrects the variation in the length of thread absorbed and/or of the tension which is the cause of triggering this rotation.

10 Claims, 8 Drawing Figures

REGULATING DEVICE FOR THE LENGTH OF THREAD ABSORBED BY A KNITTING MACHINE

BACKGROUND OF THE INVENTION

The present invention relates to a device for regulating the length of thread absorbed by a flat or circular knitting machine.

The notion of absorbed length of thread (ALT) per mesh, which was introduced by the Centre de Recherche de la Bonneterie is now well known and used by knitwear manufacturers. It is an important parameter which is taken into account in the regulation of knitting machines. The constancy of the ALT in the course of the knitting enables articles to be obtained whose dimensions will themselves be constant. The ALT is a function essentially of the adjustment of the dropping cams and of the conditions of supply of the thread. Now, for a same thread, the supply conditions will themselves be a function of the coefficient of friction of the thread: for a given adjustment of the dropping cams and adjustment of the thread-tighteners, if the coefficient of friction of the thread varies in the course of the knitting, the ALT thereof will be modified. These modifications will result in irregularities as regard the dimensions of the knitted article and its possible rejection.

To overcome this drawback, the simplest solution has been to install positive supply devices for each thread in the machine. The speed of these positive supply devices is regulated so as to deliver to the machine the length of thread corresponding to the desired ALT. Thus, whatever the coefficient of friction of the thread, the machine receives the predetermined amount of thread uniformly. This solution is not however envisageable for all types of machines. In fact, the positive supply device having a continuous operation can only be suitable in the case where the thread is distributed permanently to the needles; it is mainly suitable for circular knitting machines. On the other hand, this solution is not adapted to machines where the thread is distributed discontinuously to the needles, particularly flat knitting machines.

Another solution for overcoming the irregularities of the ALT in the course of knitting is to modify the tension of the thread supplying the machine. In fact, the variations in coefficient of friction of the thread will also be manifested by variations in the tension exerted on the thread by the various members upstream of the machine. Devices are already known intended to correct the variations in tension of the thread. Swiss Pat. No. 12 160/74 of Sept. 6, 1974 describes a device comprising a double-cup tensioning means between which the thread passes, and electromagnetic means having an action on the cups and causing the pressure exerted by the cups on the thread to be varied, this action being itself controlled by the opening or closing of the switch, caused by the friction of the thread on a guide element forming part of the switch.

In French Pat. No. 1 544 469 of Nov. 14, 1967, the variation in tension of the thread results in the movement of a roller and the action of the latter on a diaphragm pneumatic device controlling the approach or separation of the two cups of the tensioner. In French Pat. No. 71 40 701, the variation of the tension of the thread results in the movement of a rod fast to a cam which itself acts on a spring connected to the cups of the tensioning means.

Although they respond theoretically to the problem set the above-described devices have not really been applied to flat machines, either on account of resonance phenomena when it is mechanical and interdependant means which are employed, or on account of their lack of reliability, or on account of their lack of sensitivity or on account of their all or nothing action.

In addition, if the ALT is very certainly dependant on the tension of the thread supplying the machine and hence the variation of the ALT is an inverse function of the variation of this tension, it is important to note that the tension is a parameter which can vary almost momentarily: a very localised irregularity of oiling on the thread can result in a sudden variation in the tension. However, the variation in ALT which will be manifested by a fault in the knitted article is not that arising from these momentary jerks in the tension. What is useful for the quality of the finished product and what must hence be regulated, is the variation in the ALT due to a gradual change in the coefficient of friction of the thread or to a sudden variation in the average friction. The coefficient of friction can in fact vary of course from one material to another and, for the same material, from one numbering or from one presentation to another and, for the same type of thread, from one batch, from one spool, or from one color to another.

There has been found, and this is what forms the subject of the invention, a device which responds to the exigencies of knitwear manufacturers for regulating the ALT of circular and flat knitting machines, and which, consequently, enables also correction of the non-instantaneous variation in tension on a thread. This device comprises a tensioning means of known operation, whether this is a double cup tensioner, a bar tensioner, whether it is a braked rotary tensioner, or whether it is a tensioner acting by gripping the thread. It also comprises a first means for varying the tension exerted by the tensioner on the thread, a feeler element over which the thread passes and which is moved when the tension of the thread varies and a second means for controlling the action of the first means as a function of the movement of the feeler element, characterised in that the first means comprises a drive member whose rotation results in the movement of the tension generating member of the tensioner, and in that the second means comprises two switches, one controlling the placing in rotation of the drive member in one direction and the other controlling the placing in rotation in the other direction. The direction of rotation of the drive member is determined so that the tension generating member of the tensioner is moved in the direction of an increase in the tension of the thread in the case where it is the switch corresponding to a value of the ALT higher than the average normal value which has been actuated and conversely.

On the other hand, the rotation of the drive member is interrupted when, under the effect of the increase or of the decrease in the tension exerted on the thread by the movement of the tension generating member of the tensioner, and hence taking into account the consequent variation of the ALT, the feeler element is moved until it is no longer beyond or opposite the switch and comes back into the zone situated between the two switches. It is hence possible to decompose the space that the feeler element can scan into three zones. In the central zone bounded by the two contact switches, the movement of the feeler element does not result in any effect on the drive member; this zone corresponds to an acceptable variation in the ALT and the tension of the thread. On each side of this central zone are situated two zones where the presence of the feeler element results in the rotation of the drive member, for one of the zones in one direction, for the other zone in the other direction.

It is understood that with the device of the invention it will be easy, by moving one with respect to the other, each of these three zones, to obtain an accurate adjustment of the range of variation of the ALT around the average normal value which is acceptable, in the same way as the adjustment of the average normal value, as a function of the type of material, of thread, of batch and of spool.

Advantageously, the drive member whose rotation results in the movement of the tension-generating member of the tensioner comprises a motor with two directions of rotation. It may however be constituted by a motor only rotating in one direction, coupled to a reversing system, for example a rack, enabling the direction of rotation transmitted to be reversed.

The tensioner according to the invention is anyone of known tensioners. It may be taken particularly from among barrage tensioners comprising one, two or several elements in contact with the thread and where the tension exerted on the thread is a function of the contact arc between the thread and the elements which compose the bars. Among tensioners acting by gripping the thread where the tension exerted on the thread is a function of the pressure exerted by the movable gripping member on the thread; among braked rotary tensioners where the tension exerted on the thread is a function of the force exerted by the braking member on the rotating element driven by the thread. As tensioner acting by gripping the thread, may be mentioned in particular the two cup tensioner between which passes the thread and where the tension exerted on the thread is a function of the pressure exerted by a pressure member such as a spring on the two cups.

Switches controlling the rotation of the drive member in one or other direction are conventional electrical switches or preferably magnetic type ILS switches (flexible blade switches).

In the device according to the invention, the variation in the ALT results in the movement of the feeler element over which the thread passes, this movement being able to trigger the closing or opening of the switch. The feeler element comprises a thread-guide, of known type, and a rigid rod situated so that, on the movement of the feeler element, said rod comes into contact with electrical switches or opposite magnetic switches. In the case of magnetic switches of the ILS type, the rod will be matched to a magnetic mass.

The movement of the feeler element due to the variation of the ALT is a result of a variation in the length of travel of the thread between three points of which the two extremes are fixed, and the third situated between the two first is movable. It is this third point which is materialised by the thread-guide of the feeler element and which is moved as a function of the variations in the ALT and the tension exerted on the thread. If the ALT increases and hence the tension decreases, the length of the path tends to increase; if the ALT decreases and hence the tension increases, the length of the course tends to diminish. The third point which is moved to follow the variation in the length of the travel of the thread may be moved from above downwards or from below upwards for the same length variation.

These two possibilities have given two embodiments. In the first embodiment, the feeler element comprises a mass whose constant weight communicates by means of the thread-guide to the thread a certain constant tension, it is on this mass that the rigid rod which actuate the two switches is fixed. In the second embodiment, the thread-guide of the feeler element is fixed to the end of a lever oscillating around a fixed axle, the other end of said lever acting as a rigid rod and actuating the two switches. Advantageously, the end of the lever serving as a rigid rod is equipped with a counterweight movable along said lever, so as to regulate by simple movement of said counterweight the tension exerted on the thread by means of the thread-guide. Advantageously, the supports of the switches are fast to the axle around which the lever pivots, so as to enable the movement of said switches with respect to the rigid rod and hence the adjustment of the three zones by simple rotation of said supports around said axle.

Advantageously, a detection system is placed in the path of the thread downstream of the device according to the invention and upstream of the knitting machine, the detection system having the purpose of detecting if the thread is moved or not and blocking the operation of the device for regulating the ALT in the case where the thread would not be moved.

BRIEF DESCRIPTION OF THE DRAWINGS

The invention will be better understood by means of the embodiments given below by way of indication, but which are in no way limiting, and which are illustrated by the accompanying drawings.

In the drawings.

DESCRIPTION OF PREFERRED EMBODIMENTS

The thread 2 supplying the flat knitting machine of which only the needles 16 are shown is paid out from its spool 1 by alternate movements of the carriage of the machine, actuating the thread take-up by the needles 16.

Figure 1:
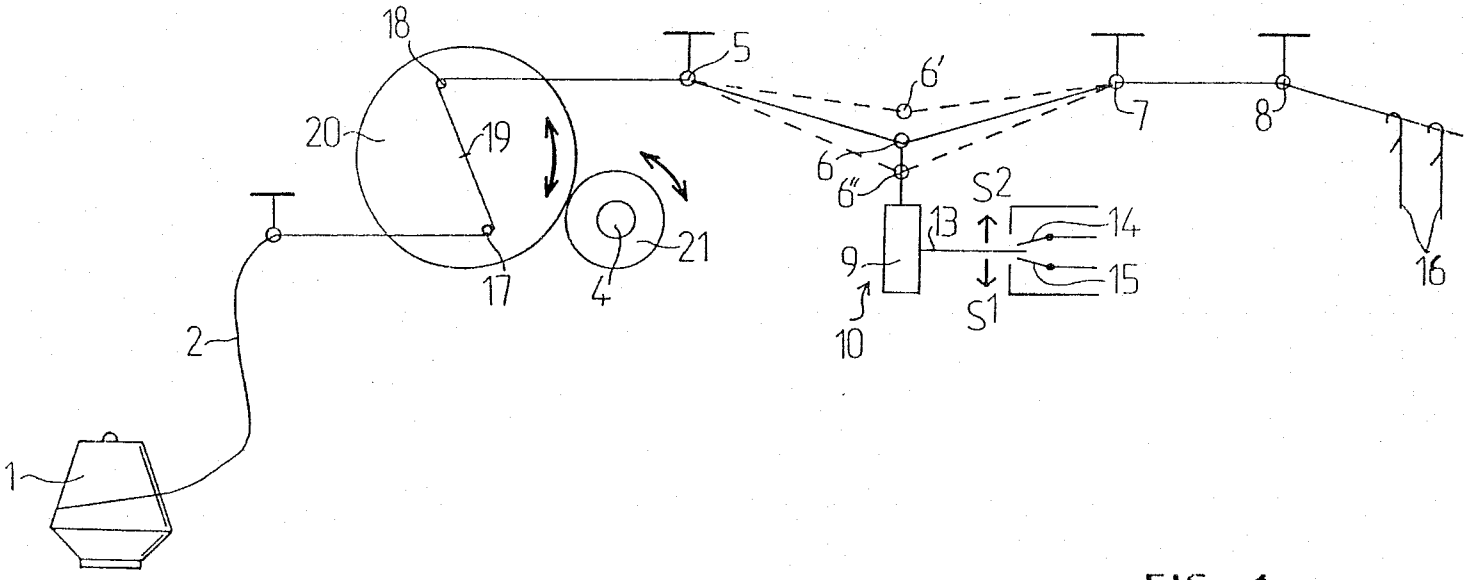
FIG. 1 shows a device according to the invention in which the feeler element comprises a mass acting by gravity on the thread, the contact switches are conventional electrical switches and the tensioning means is a tensioner with two barrage elements.

In the embodiment illustrated by FIG. 1, the thread 2 passes over the fingers 17 and 18 of the tensioner 3, so as to form a barrage means before passing over the thread guide 5. The two fingers 17 and 18 are fixed to one of the flat surfaces of a cylindrical support 20, symetrically with respect to the axle 19 of said support. The rotation of the cylindrical support causes the contact arc of the thread with the two fingers of the barrage means to vary and therefore to vary the tension exerted on the thread. This rotation is controlled by the drive member which comprises the two way-rotating motor 4, and a wheel 21 in contact with the surface of revolution of the support 20 and driven by the motor 4.

Thus, the rotation of the motor 4 in one direction results in an increase in the contact arcs between the thread 2 and the barrage means fingers 17 and 18, increases consequently the tension exerted on the thread by the tensioner 3 and results in a reduction of the ALT. The reverse effect is produced by the rotation of the motor 4 in the other direction.

The feeler element 10 is constituted by a thread guide 6 connected to the mass 9 on which the finger 13 is fixed (FIG. 1). The feeler element can be moved vertically inside a chamber bounded, for example, by studs (not shown).

The switches 14 and 15 are located on each side of the finger 13, the movement of the finger 13 in the direction of the arrow S1 closing the switch 15, the movement of the finger 13 in the direction of the arrow S2 closing the switch 14. The closing of the switch 15 actuates the rotation of the motor 4 in the direction resulting in increase in the contact arcs between the thread 2 and the barrage fingers 17 and 18, that of the switch 14 actuates the rotation of t the motor 4 in the direction resulting in the decrease in the contact arcs.

When the knitting machine is in operation, the thread 2 passes through the tensioner, the thread guide and the feeler element before arriving at the needles; the thread possesses a certain tension which is determined to obtain a given ALT. This tension is a function particularly of the value of the contact arcs between the thread 2 and the barrage fingers 17 and 18, and of the mass of the feeler element, this mass having been selected taking into account the desired tension. In the course of operation and for a constant ALT, the feeler element 10 is in equilibrium between the fixed thread guides 5 and 7. In fact the length of the loop 5-6-7 formed by the thread is defined by the position of the feeler element 10 and the equilibrium of the forces exerted on the thread on each side of the feeler element and the constant force resulting from the action of the mass 9. When the coefficient of friction of the thread changes in the course of the operation of the machine, the equilibrium of the forces is broken. If the coefficient of friction increases and hence the ALT diminishes, all the forces exerted by friction on the thread upstream of the needles 16 will increase and will move from below upwards the feeler element 10 of which the constant mass counters said forces: the thread guide will pass from position 6 to 6', the finger 13 following the direction of the arrow S2 will close the switch 14 which actuates the rotation of the motor 4 in the direction of diminishing the contact arcs between thread 2 and the barrage fingers 17 and 18; the frictional force exerted by the tensioner 3 on the thread 2 will diminish: the feeler element will again be moved from 6' to 6 until the finger 13 recovers a position where the switch 14 is again open, said position corresponding to an acceptable value of the ALT. The procedure is, of course, reversed when the coefficient of friction of the thread diminishes in the course of operation of the machine and hence the ALT increases: the movement of the thread guide of the feeler element will be from 6 to 6", of the finger 13 in the direction of the arrow S1, the switch 15 will be closed which results in the rotation of the motor 4 in the direction of increasing the contact arcs between the thread 2 and the barrage fingers 17 and 18, the frictional force exerted by the tensioner 3 on the thread will increase and the feeler element will come back to its equilibrium position where the finger 13 leaves the switch 15 to find itself in the zone inermediate between the two switches 14 and 15.

Figure 2:
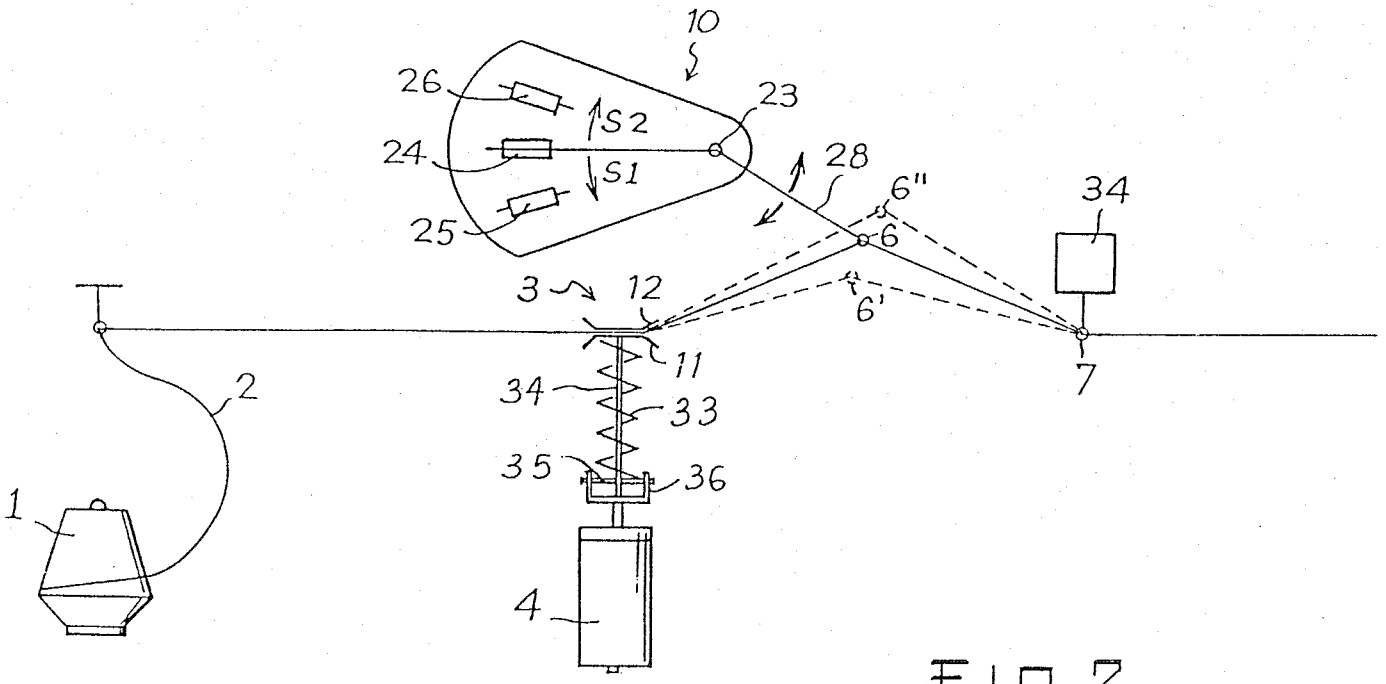
FIG. 2 shows a device according to the invention in which the feeler element comprises an oscillating lever, the contact switches are ILS type magnetic switches and the tensioner is a double cup tensioner.
Figure 3:
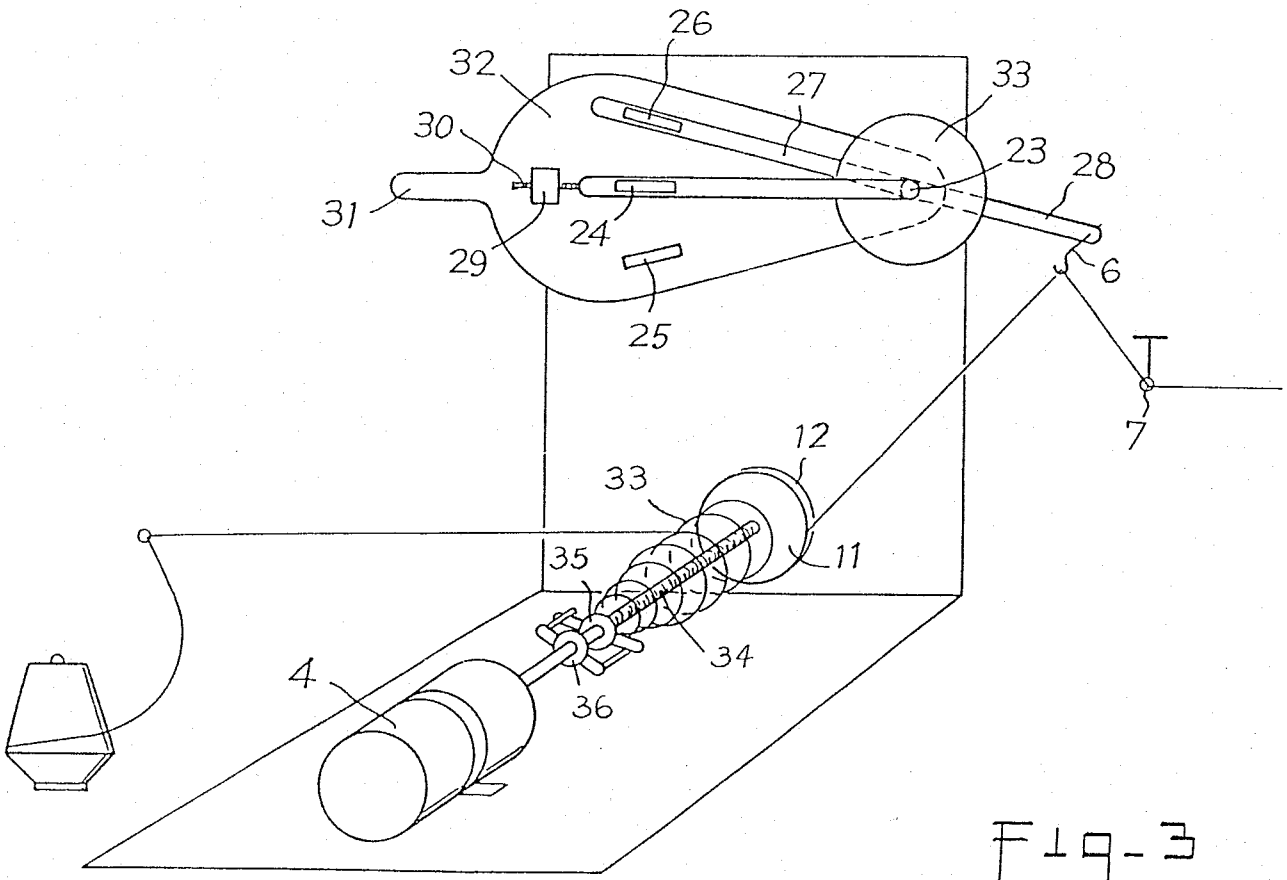
FIG. 3 is a partial and detailed view of the embodiment illustrated in FIG. 2.

In the second embodiment illustrated by FIGS. 2 and 3, the tensioner is a double cup tensioner. The thread 2 passes between the cups 11 and 12 of the tensioner 3. The upper cup 12 is fixed: the lower cup 11 can by moved in height and, applied more or less to the thread 2 which is moved between the two cups, can exert on said thread a greater or lesser pressure, by means of the drive member which comprises the motor 4 with two directions of rotation, an element 35, a threaded rod 34 and a spring 33: the rotation communicated by the motor 4 is transmitted to the element 35, then transformed into a linear movement of this element 35 along the threaded rod 34, said element compressing or decompressing the spring 33 which exerts a pressure on the lower cup 11. In the present embodiment, the element 35 is a wing nut rotated by means of two arms of another wing nut 36 fast to the axle of the motor 4. It could also have been a gear wheel rotated by another gear wheel fast to the axle of the motor 4. Thus, the rotation of the motor 4 in one direction results in the compression of the spring 33, increases the pressure of the cup 11 on the cup 12, increases the tension exerted on the thread by the tensioner 3 and results in a reduction in the ALT. The reverse effect is produced by rotation of the motor 4 in the other direction.

Feeler element 10 is constituted by a lever 28 oscillating around a horizontal axle 23, one end of said lever being terminated by the thread guide 6, while the other comprises a magnetic portion 24. The principle of equilibrium of the forces is identical with that disclosed in the first embodiment, with the exception that the mass corresponding to the magnet 24 exerts, through the lever 28 oscillating around the horizontal axle 23, a force from below upwards on the thread 2 passing into the thread guide and not from above downwards as in the preceding example. The magnet 24 may be equipped with a counterweight 29 sliding along the threaded rod 30: the adjustment of the force that is desired to apply to the thread 2 is obtained by selecting the given counterweight 29 and, for a same counterweight, by moving it along the threaded rod 30. The magnet 24 is located in a zone limited by the two magnetic switches of type ILS, the one controlling the placing in rotation of the motor 4 in one direction and the other the placing in rotation of the motor 4 in the other direction. The ILS switches are positioned so that, when the thread guide 6 of the feeler element 10 is moved towards 6' under the effect of a reduction of the ALT due to an increase in the coefficient of friction of the thread 2, the arm of the lever 28 supporting the magnet 24 is moved in the direction of the arrow S2, the magnet 24 closes the magnetic switch 26 which controls the rotation of the motor 4 in the direction which results in the decompression of the spring 19 and the separation of the cups 11 and 12: the ALT increases and the tension of the thread decreases until the feeler element 10 recovering its equilibrium position, the magnet itself also recovers its intermediate position, the switch 26 being open and the motor 4 stopped; in the same way, conversely, with the element 6 towards 6" and with the action of the switch 25, in the case of a reduction in the tension of the thread 2. This second embodiment enables the predetermined tension on the thread to be regulated to values below those of the first modification. The adjustment of the acceptable range for the variations of the ALT is done by means of different means enabling the positioning of the ILS 25 and 26 on each side of the end of the lever 28 supporting the magnet 24, once the position of the latter will be determined. The positioning means of the ILS are, in the embodiment illustrated by FIG. 3, a first support 32 possessing a handle 31 and movable in rotation around the axle 23, on which the ILS 25 is fixed whilst the ILS 26 is fixed to a second support 27 movable in rotation around the axle 23, the second support 27 being fastenable by suitable locking to the first support 32. Thus, the separation between the switches 25 and 26 fixing the zone corresponding to an acceptable ALT is obtained by means of the movement of the second support 27 with respect to the first support 32, and the adjustment of device is obtained by movement of the first support 32 so that the two switches 25 and 26 are equidistant from the magnet 24 in the equilibrium position for the average value of the desired ALT.

The stability of the oscillating lever 10 is ensured by its V shape, such that its central gravity occurs below the axis of rotation 23, and on the other hand by an inertial mass fast to the axle 23.

The thread guide 7 situated immediately upstream of the knitting machine forms part of a detection system 34 which detects if the thread is moved or not and only permits the regulation device of the ALT in the case of a movement of the thread.

The system is particularly useful when the regulation device of the ALT is adapted to non-circular knitting machines where the supply of the thread to the machine follows an alternating movement; in this case, the information of arrest or movement of the thread to the regulating device of the ALT is indispensable so as not to experience, at the end of the needle beds any inadvertent and troublesome actions of the regulation device concerned, for example, of the normal relaxation of the thread on stopping between a left right, right left or right left, left right run. This detection system is also useful on stoppages of the knitting machine for any reason; in fact, in this case, the thread 2 will have a tendancy to relax and the thread guide 6 to come into position 6'', which, if the detection system does not block the regulation device of the ALT, will result in the closing of the switch 25 and by rotation of the motor 4, the compression of the spring 19, without increase in tension on the thread being manifestable by a reduction in the ALT and a return of the feeler element 10 towards its equilibrium; on restarting the machine, the tensioner exerting an excessive tension, the thread would break.

Figure 4:
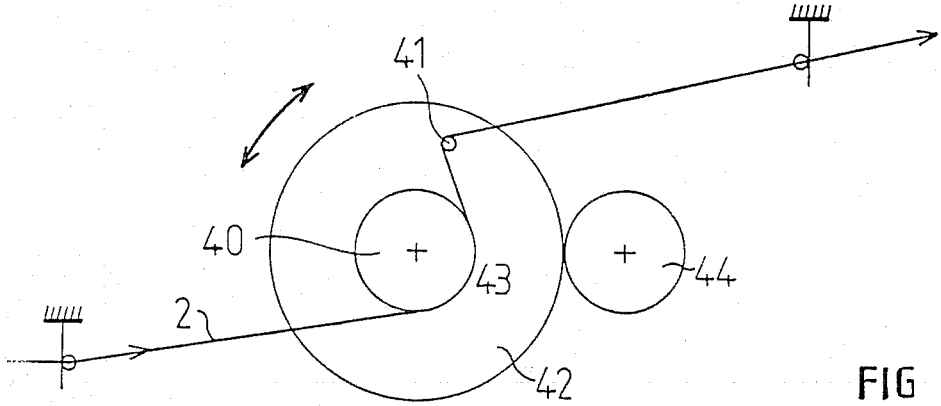
FIGS. 4 to 8 are illustrations of diferent types of tensioners: in a two barrage tensioner (FIG. 4), a multiple barrage tensioner (FIG. 5), a so called tap tensioner (FIG. 6), a ball tensioner (FIG. 7), a rotray tensioner braked by mechanical friction (FIG. 8).
Figure 5:
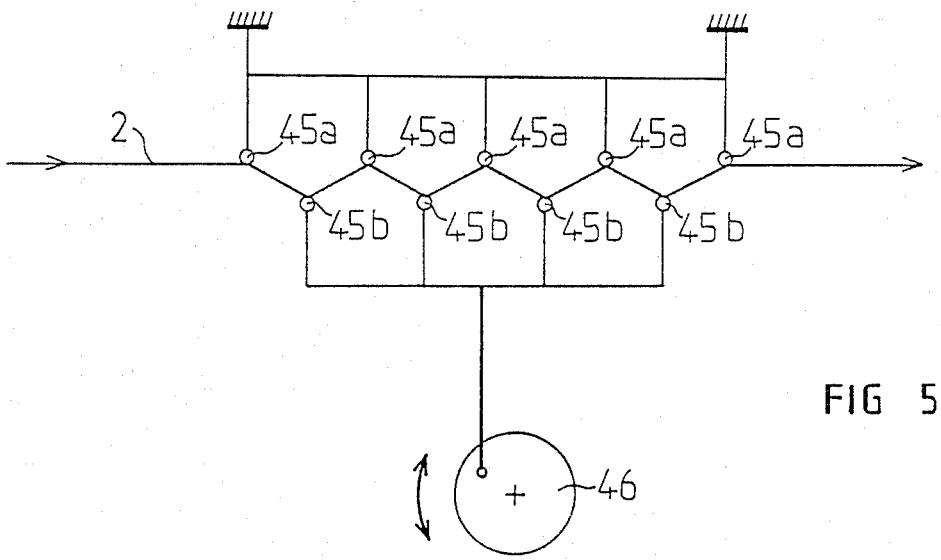
Figure 6:
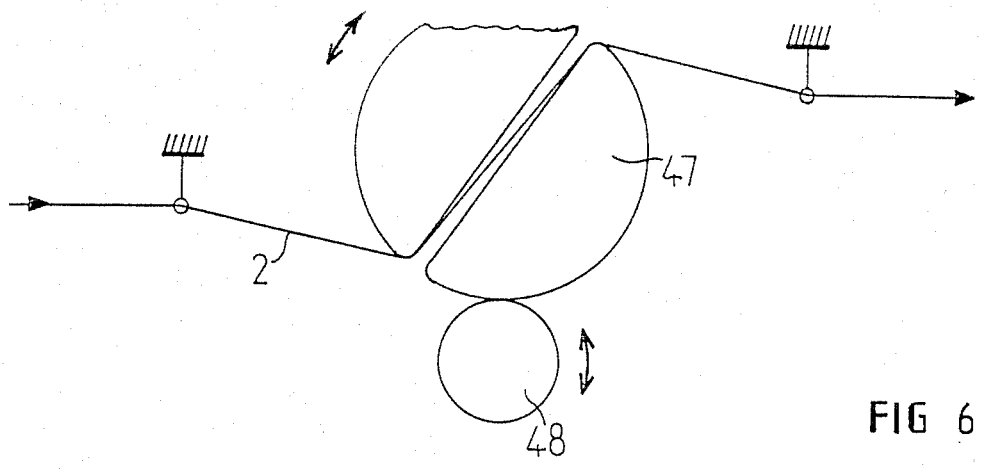

The tensioner employed in the first embodiment illustrated by FIG. 1 is a tensioning means comprising as tension-generating member two barrage elements. Like all barrage tensioning means, it acts by friction of the thread on the barrage elements; the adjustment of the tension is effected by causing the contact arc between the thread and said elements to vary. FIGS. 4 to 6 illustrate non-limiting examples of tensioners operating according to the same principle. The tension generating member of the tensioner shown diagrammatically in FIG. 4 also comprises two barrage elements, one 40 is a fixed cylindrical frictional body and the other 41 is barrage finger mounted on a cylindrical support 42, rotating around its axle 43; the movement of this tension generating member is a rotary movement around the axle 43 caused by the rotation of the wheel 44 which is in contact with the surface of revolution of the cylinder 42, and which is driven by the motor 4 (not shown).

Tension generating member of the tensioner shown diagrammatically on FIG. 5 consists of a thread guide unit **45*b* into which the thread passes, which is intercalated with another thread guide unit 45*a*. The latter unit is fixed, whereas the unit 45*b* is movable vertically under the action of a double acting cam 46, self actuated in rotation by a motor member 4 (not shown). The tension generating member of the tensioner called tap type shown diagrammatically in FIG. 6 is a body 47, pierced from side to side and through which the thread 2 passes, movable in rotation, and its movement is driven by a wheel 48 in contact with the surface of revolution of body 47, itself rotated by the motor member 4** (not shown).

Figure 7:
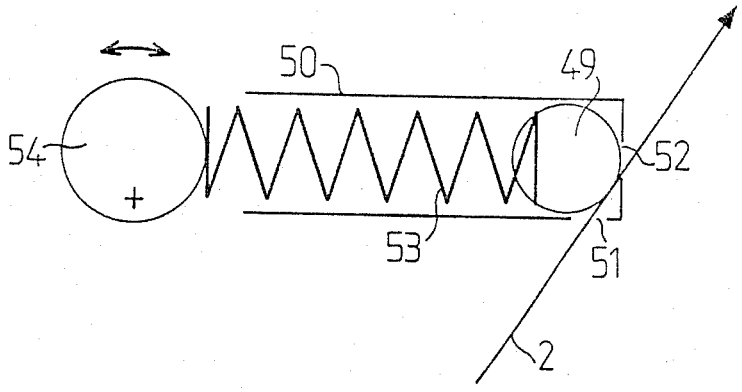

The tensioner employed in the second embodiment illustrated by FIGS. 2 and 3 is a double cup tensioner. Like the other example of a tensioner acting by gripping of the thread, FIG. 7 shows a ball tensioner, where the tension generating member comprises a ball 49 or possibly a pressure shoe; The thread 2 enters a tube 50 through an orifice 51 formed in the side wall of said tube and emerges there-from through an orifice 52 fashioned in the flat wall. In contact with this wall, the thread 2 is gripped by the ball 49. The variation in tension is caused by more or less stronger or weaker application of the ball 49 to the thread 2, under the effect of a spring 53, which is more or less compressed by the action of a cam 54, actuated in rotation by a drive member 4 (not shown).

Figure 8:
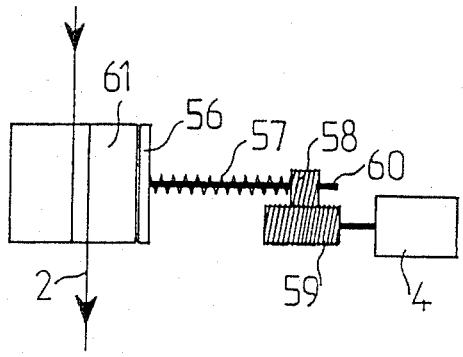

It is possible to use braked rotary tensioners. In these tensioners, the thread passes over a wheel 61 free in rotation around its axis, this wheel is rotated by the friction of the thread on its surface of revolution. The tension generating member of this type of tensioner is a member for braking the wheel driven by the thread. The braking can be caused by friction between the wheel 61 and the braking member, whether this friction is mechanical, as in the example illustrated in FIG. 8, or magnetic (Eddy currents, hysteresis); it may also result from a resisting counter-torque created, for example, by a motor. The tension generating member shown in FIG. 8 comprises a disk 56 which is urged on to a flat surface of the wheel 61, a spring 57 surrounding a threaded rod 60 mounted on the axle of the disk 56 and a gear 58 moving on its rotation on the threaded rod 60. The motor member 4 through a gear wheel 59, causes the gear wheel 59 to rotate, which results in the rotation of the wheel 58 which through this fact is moved along the thread rod 60. The rotation of the drive member 4 in one direction results in the movement of the threaded rod 60 towards compression of the spring 57, and hence a greater application of the brake-disk to the wheel 61: the rotation of the drive member 4 in the other direction reduces the braking force applied to the wheel 61.

As has just been described, the device according to the invention regulates the length of the thread absorbed by the knitting machine. Its particular field of application is constituted by machines where the positive supply of the thread by the supplier is either impossible, or too burdensome; this is the case particularly with circular knitting machines with striping units, Jacquard flat or circular knitting machines; flat or Cotton knitting machines, socks, hose or pantyhose knitting machines, sock and stocking looms, as well as all circular machines of small diameter. As has also been stated, this device is also useful to correct non-momentary variations in the tension of the thread, which permits its employment on any other equipment than knitting machines where it is important to regulate this tension around an average value, particularly all winding and spooling equipment.

What is claimed is:

1. A device for regulating the absorbed length of thread per mesh of a knitting machine and for correcting variations in tension of a thread supplying a textile machine comprising tensioning means comprising a movable member arranged to cause movement thereof to tension said thread, a reversible electric motor, means coupling said motor to said movable member to cause rotation of said motor to produce movement of said member, movable sensing means comprising a thread guide for receiving said thread and a mass weighing on said guide so that the thread guide exerts on the thread a force counterbalanced by the tension in the thread, variations in absorbed length of thread per mesh or in tension of said thread producing movement of said sensing means, first switch means responsive to movement of said sensing means in one way for energizing said motor to rotate in one direction and second switch means responsive to movement of said sensing means in the other way for energizing said motor to rotate in the reverse direction.

2. The device of claim 1, wherein said sensing means comprises a rigid rod, arranged so that movement thereof causes the closing or the opening of said switch means.

3. The device of claim 2, wherein said sensing means comprises a lever having a first and a second arm and rocking around a horizontal axle, said thread guide being arranged on said first arm and said rigid rod being arranged on said second arm.

4. The device of claim 3, including a slidable counterweight on said rigid rod.

5. The device of claim 2, comprising switch positioning means enabling modification of the spacing between said switch means and the position of said switch means with respect to said rigid rod.

6. The device of claim 1, wherein the switch means are of electrical type.

7. The device of claim 1, wherein the switch means are of magnetic type and the sensing element comprises a magnetic element.

8. The device of claim 1, wherein said tensioning means being of the barrage type with barrage elements, the rotation of said motor in one direction increases the contact arc between the thread and said barrage elements, and the rotation of said motor in the other direction reduces this contact arc.

9. The device of claim 1, wherein said tensioning means being of the gripping type with gripping element, the rotation of said motor in one direction increases the pressure of said gripping element on the thread, and the rotation of the drive member in the other direction reduces this pressure.

10. The device of claim 1, wherein the tensioning means being of the braked rotary type, with a wheel drawn by the thread and a brake element, the rotation of said motor in one direction increases the braking force exerted by said brake element on said wheel and the rotation of said motor in the other direction reduces this braking force.

* * * * *